US005817192A

United States Patent [19]

Kawai et al.

[11] Patent Number: 5,817,192

[45] Date of Patent: Oct. 6, 1998

[54] HIGH-STRENGTH AND HIGH-TOUGHNESS HEAT-RESISTING STEEL

[75] Inventors: Hisataka Kawai; Toshio Sakon; Yoshikuni Kadoya; Ichirou Tsuji; Ryotarou Magoshi, all of Hyogo-ken, Japan

[73] Assignee: Mitsubishi Jukogyo Kabushiki Kaisha, Tokyo, Japan

[21] Appl. No.: 737,834

[22] PCT Filed: Apr. 10, 1996

[86] PCT No.: PCT/JP96/00981

§ 371 Date: Nov. 21, 1996

§ 102(e) Date: Nov. 21, 1996

[87] PCT Pub. No.: WO96/32517

PCT Pub. Date: Oct. 17, 1996

[30] Foreign Application Priority Data

Apr. 12, 1995 [JP] Japan ..... 7-086629

[51] Int. Cl.[6] ..... C22C 38/52; C22C 38/44

[52] U.S. Cl. ..... 148/325; 148/326; 420/38

[58] Field of Search ..... 148/325, 326; 420/38

[56] References Cited

U.S. PATENT DOCUMENTS

| | | | |
|---|---|---|---|
| 5,310,431 | 5/1994 | Buck . | |
| 5,415,706 | 5/1995 | Scarlin et al. | 148/325 |
| 5,560,788 | 10/1996 | Yamada et al. | 420/38 |

FOREIGN PATENT DOCUMENTS

| | | | |
|---|---|---|---|
| 0626463A | 11/1994 | European Pat. Off. . | |
| 0639691A | 2/1995 | European Pat. Off. . | |
| 52-001203 | 1/1977 | Japan . | |
| 53-42446 | 11/1978 | Japan . | |
| 60-13056 | 1/1985 | Japan | 420/38 |
| 60-165359 | 8/1985 | Japan . | |
| 61-133365A | 6/1986 | Japan . | |
| 62-177157 | 8/1987 | Japan . | |
| 62-218515 | 9/1987 | Japan . | |
| 04-147948 | 5/1992 | Japan . | |
| 04147948A | 5/1992 | Japan . | |
| 05-222450A | 8/1993 | Japan . | |
| 07034202 | 2/1995 | Japan . | |

*Primary Examiner*—Deborah Yee
*Attorney, Agent, or Firm*—Bell Seltzer Intellectual Property Law Group of Alston & Bird LLP

[57] ABSTRACT

This invention relates to a high-strength and high-toughness heat-resisting steel formed from a heat-resisting steel containing, on a weight percentage basis, 0.08 to 0.25% carbon, up to 0.10% silicon, up to 0.10% manganese, 0.05 to 1.0% nickel, 10.0 to 12.5% chromium, 0.6 to 1.9% molybdenum, 1.0 to 1.95% tungsten, 0.10 to 0.35% vanadium, 0.02 to 0.10% niobium, 0.01 to 0.08% nitrogen, 0.001 to 0.01% boron, and 2.0 to 8.0% cobalt, the balance being substantially iron, and having a structure consisting of a tempered martensite matrix.

7 Claims, 6 Drawing Sheets

(Numerical values designate weight percentages.)

| Sample No. | | Chemical compostion | | | | | | | | | | | | | | | Mo equivalent, formula (1) | Cr equivalent, formula (2) | B equivalent, formula (3) | Nb equivalent, formula (4) |
|---|---|---|---|---|---|---|---|---|---|---|---|---|---|---|---|---|---|---|---|---|
| | | C | Si | Mn | P | S | Ni | Cr | Mo | W | V | Nb | N | B | Co | Fe | | | | |
| Inventive steels | 1 | 0.11 | 0.05 | 0.05 | 0.013 | 0.002 | 0.50 | 11.0 | 0.80 | 1.80 | 0.20 | 0.050 | 0.025 | 0.004 | 4.5 | Balance | 1.70 | 3.40 | 0.016 | 0.094 |
| | 2 | 0.11 | 0.05 | 0.05 | 0.013 | 0.002 | 0.50 | 11.0 | 0.80 | 1.20 | 0.20 | 0.050 | 0.050 | 0.004 | 6.0 | Balance | 1.40 | -1.25 | 0.029 | 0.094 |
| | 3 | 0.11 | 0.05 | 0.05 | 0.013 | 0.002 | 0.50 | 11.0 | 1.50 | 1.00 | 0.20 | 0.050 | 0.025 | 0.004 | 6.0 | Balance | 2.00 | 2.00 | 0.016 | 0.094 |
| | 4 | 0.11 | 0.05 | 0.05 | 0.013 | 0.002 | 0.50 | 11.0 | 1.50 | 1.80 | 0.20 | 0.050 | 0.050 | 0.004 | 4.5 | Balance | 2.40 | 5.45 | 0.029 | 0.094 |
| | 5 | 0.11 | 0.05 | 0.05 | 0.013 | 0.002 | 0.30 | 10.4 | 0.68 | 1.78 | 0.20 | 0.050 | 0.025 | 0.004 | 4.5 | Balance | 1.57 | 3.09 | 0.016 | 0.094 |
| | 6 | 0.11 | 0.05 | 0.05 | 0.013 | 0.002 | 0.08 | 10.4 | 0.68 | 1.78 | 0.20 | 0.050 | 0.025 | 0.004 | 4.5 | Balance | 1.57 | 3.97 | 0.016 | 0.094 |
| | 7 | 0.11 | 0.05 | 0.05 | 0.013 | 0.002 | 0.08 | 10.4 | 0.68 | 1.78 | 0.20 | 0.050 | 0.025 | 0.004 | 3.4 | Balance | 1.57 | 6.17 | 0.016 | 0.094 |
| | 8 | 0.11 | 0.05 | 0.05 | 0.013 | 0.002 | 0.08 | 10.4 | 0.68 | 1.78 | 0.20 | 0.050 | 0.025 | 0.002 | 4.5 | Balance | 1.57 | 3.97 | 0.014 | 0.094 |
| Comparative steels | 9 | 0.11 | 0.05 | 0.05 | 0.013 | 0.002 | 0.50 | 11.0 | 1.50 | 2.60 | 0.20 | 0.050 | 0.050 | 0.004 | 4.5 | Balance | 2.80 | 6.65 | 0.029 | 0.094 |
| | 10 | 0.11 | 0.05 | 0511 | 0.013 | 0.002 | 0.50 | 11.0 | 0.40 | 0.80 | 0.20 | 0.050 | 0.050 | 0.004 | 4.5 | Balance | 0.80 | -0.45 | 0.029 | 0.094 |
| | 11 | 0.12 | 0.06 | 0.49 | 0.010 | 0.002 | 0.50 | 10.4 | 0.30 | 2.00 | 0.19 | 0.050 | 0.050 | —— | — | Balance | 1.30 | 8.02 | 0.025 | 0.098 |
| | 12 | 0.09 | 0.08 | 0.45 | 0.010 | 0.006 | 0.53 | 11.2 | 0.15 | 2.61 | 0.20 | 0.060 | 0.030 | 0.019 | 2.9 | Balance | 1.45 | 5.21 | 0.034 | 0.097 |

(Notes) Formula (1) Mo Equivalent = Mo + 0.5W (A value of 1.40 to 2.45% is claimed by the present invention.)
Formula (2) Cr equivalent = Cr + 6Si + 4Mo + 1.5W + 11V + 5Nb - 40C - 2Mn - 4Ni - 2Co - 30N (A value of 7.5% or less is claimed by the present invention.)
Formula (3) B equivalent = B + 0.5N (A value of 0.030% or less is claimed by the present invention.)
Formula (4) Nb equivalent = Nb + 0.4C (A value of 0.12% or less is claimed by the present invention.)

FIG. 1.

| Properties / Sample No. | | Tensile strength ($kgf/mm^2$) | 0.2% yield strength ($kgf/mm^2$) | Elongation (%) | Reduction of area (%) | Impact value ($kgf\text{-}m/cm^2$) | 50%FATT (°C) | $10^5$ hr creep rupture strength ($kgf/mm^2$) | |
|---|---|---|---|---|---|---|---|---|---|
| | | | | | | | | 600 °C | 650 °C |
| Inventive steels | 1 | 95.5 | 76.7 | 18 | 62 | 8.8 | 24 | 15.3 | 10.5 |
| | 2 | 94.5 | 75.8 | 18 | 64 | 9.0 | 20 | 13.8 | 9.70 |
| | 3 | 95.8 | 76.4 | 18 | 60 | 10.1 | 18 | 15.0 | 10.6 |
| | 4 | 98.5 | 78.3 | 18 | 63 | 7.5 | 25 | 15.7 | 11.0 |
| | 5 | 91.3 | 76.9 | 20 | 65 | 5.2 | 32 | 15.5 | 10.2 |
| | 6 | 90.2 | 76.0 | 20 | 63 | 6.5 | 37 | 16.0 | 11.2 |
| | 7 | 91.4 | 77.0 | 21 | 64 | 4.1 | 40 | 15.0 | 10.3 |
| | 8 | 92.0 | 76.1 | 20 | 65 | 5.0 | 45 | 14.5 | 10.0 |
| Comparative steels | 9 | 95.4 | 77.5 | 17 | 58 | 5.1 | 41 | 11.5 | 8.80 |
| | 10 | 92.3 | 73.4 | 19 | 73 | 14.5 | 3 | 10.8 | 8.90 |
| | 11 | 88.2 | 75.8 | 19 | 59 | 8.9 | 20 | 10.5 | 8.50 |
| | 12 | 93.1 | 76.0 | 22 | 64 | 0.8 | 90 | 14.8 | 10.2 |

FIG. 2.

| Sample No. | | Creep rupture conditions: Temperature x stress | Creep rupture conditions: Rupture time (h) | Particle diameter of $M_{23}C_6$ carbides (nm) | Cube ofparticle diameter of $M_{23}C_6$ carbides at $10^4$ hours ($nm^3$) | Co content (wt.%) |
|---|---|---|---|---|---|---|
| Inventive steels | 2 | 650 °Cx16kgf/mm2 | 1078 | 221 | $5.8 \times 10^6$ | 6.0 |
| | | 650 °Cx12kgf/mm2 | 2487 | 254 | | |
| | 5 | 650 °Cx16kgf/mm2 | 1719 | 187 | $1.8 \times 10^6$ | 4.5 |
| | | 650 °Cx14kgf/mm2 | 2587 | 193 | | |
| | 7 | 650 °Cx16kgf/mm2 | 1105 | 168 | $1.6 \times 10^6$ | 3.4 |
| | | 650 °Cx14kgf/mm2 | 2055 | 180 | | |
| Comparative steels | 11 | 650 °Cx16kgf/mm2 | 267 | 150 | $2.8 \times 10^6$ | 0 |
| | | 650 °Cx12kgf/mm2 | 1328 | 189 | | |

FIG. 3.

| Sample No. | | Metallo-graphic structure (Note 1) | After heat treatment | After creep rupture | | Type and amount of precipitates (wt.%) | | | | | | $10^5$ hr creep rupture strength ($kgf/mm^2$) |
|---|---|---|---|---|---|---|---|---|---|---|---|---|
| | | | | Temperature x stress | Rupture time (h) | $M_{23}C_6$ carbides | MX carboni-trides | Laves phases | Division | Combined amount | ②-① | 600 °C |
| Inventive steels | 2 | 100% tempered martensite | As-tempered material | — | — | 1.97 | 0.12 | 0.05 | ① | 2.14 | — | 13.8 |
| | | | — | 600°Cx25kgf/mm2 | 664 | 1.95 | 0.14 | 0.07 | ② | 2.16 | 0.02 | |
| | | | — | 650°Cx16kgf/mm2 | 1078 | 1.98 | 0.12 | 0.06 | ② | 2.16 | 0.02 | |
| | 5 | 100% tempered martensite | As-tempered material | — | — | 1.94 | 0.09 | 0.08 | ① | 2.11 | — | 15.5 |
| | | | — | 600°Cx25kgf/mm2 | 823 | 1.98 | 0.10 | 0.10 | ② | 2.18 | 0.07 | |
| | | | — | 650°Cx16kgf/mm2 | 1719 | 1.97 | 0.11 | 0.08 | ② | 2.16 | 0.05 | |
| | 7 | 100% tempered martensite | As-tempered material | — | — | 2.05 | 0.12 | 0.10 | ① | 2.27 | — | 15.0 |
| | | | — | 600°Cx25kgf/mm2 | 883 | 2.10 | 0.11 | 0.12 | ② | 2.33 | 0.06 | |
| | | | — | 650°Cx16kgf/mm2 | 1105 | 2.12 | 0.12 | 0.10 | ② | 2.34 | 0.07 | |
| Comparative steels | 11 | 100% tempered martensite | As-tempered material | — | — | 2.39 | 0.13 | 0 | ① | 2.52 | — | 10.5 |
| | | | — | 600°Cx25kgf/mm2 | 489 | 2.50 | 0.12 | 0.15 | ② | 2.77 | 0.25 | |
| | | | — | 650°Cx16kgf/mm2 | 267 | 2.52 | 0.12 | 0.08 | ② | 2.72 | 0.20 | |

(Note 1) The metallographic structures of sample Nos. 1 to 12 are all 100% tempered martensite structures.
(Note 2) Combined amount = sum of the amounts of various precipitates ($M_{23}C_6$ carbides + MX carbonitrides + Laves phases)

FIG. 4.

HIGH-STRENGTH AND HIGH-TOUGHNESS HEAT-RESISTING STEEL

TECHNICAL FIELD

This invention relates to heat-resisting steels for use in large-sized forged products such as the high-pressure and intermediate-pressure rotors of steam turbines and the rotors of gas turbines. More particularly, it relates to heat-resisting steels which are suitable for use in the high-pressure and intermediate-pressure rotors of steam turbines operated at a steam temperature of 593° C. or higher and which have high creep rupture strength at high temperatures within the range of 550° to 650° C. and excellent toughness at room temperature.

BACKGROUND ART

In thermal electric power plants, higher temperatures and higher pressures are recently aimed at from the viewpoint of efficiency improvement. The goal of the steam temperature of steam turbines is being raised from the current maximum level of 593° C. to 600° C. and ultimately to 650° C. In order to raise the steam temperature, a heat-resisting material having more excellent high-temperature strength than conventionally used ferritic heat-resisting steels is required. One measure for this purpose is to use an austenitic heat-resisting alloy. To be sure, some austenitic heat-resisting alloys have excellent heat-resisting strength. Under the present situation, however, they cannot be put to practical use, for example, because they have poor thermal fatigue owing to their high coefficients of thermal expansion, they are expensive, and they are problematic from the viewpoint of design and fabrication.

Meanwhile, the so-called Cr—Mo—V steels and 12% Cr heat-resisting steels as described in Japanese Patent Publication 40-4137 and the like have conventionally been used for the high-pressure and intermediate-pressure rotors of large-sized steam turbines.

In the case of Cr—Mo—V steels, they have low strength at high temperatures and fail to provide various properties stably. Consequently, the resulting rotors are cooled with low-temperature steam. However, their limit of use will be exceeded under the above-described steam conditions being planned at present, so that Cr—Mo—V steels cannot be used for high-temperature rotors under this plan.

In the case of 12% Cr heat-resisting steels, they have higher strength at high temperatures than Cr—Mo—V steels. However, they show a reduction in long-time creep rupture strength at a steam temperature of 593° C. or above, so that their limit of use will be exceeded.

For these reasons, a large number of new heat-resisting steels showing an improvement in long-time creep rupture strength have been proposed in recent years. Examples of such heat-resisting steels include those disclosed in Japanese Patent Laid-Open No. 62-103345, Japanese Patent Laid-Open No. 61-69948, Japanese Patent Laid-Open No. 57-207161, Japanese Patent Publication No. 57-25629, Japanese Patent Laid-Open No. 4-147948 and Japanese Patent Laid-Open No. 7-34202. Another heat-resisting steel over which the present invention has made an improvement is that disclosed in Japanese Patent Laid-Open No. 7-216513. Among them, 12% Cr heat-resisting steels containing Co are proposed by Japanese Patent Laid-Open No. 4-147948 and Japanese Patent Laid-Open No. 7-34202.

The steel of the former Japanese Patent Laid-Open No. 4-147948 is a heat-resisting steel in which Co is added in a relatively larger amount than in conventional alloys of the same type and in which Mo and W are added concurrently, but importance is attached to W rather than Mo in that W is added in a larger amount than conventional. When this alloy composition is compared with that of the present invention, they differ from each other, especially in the contents of Mo and W. Accordingly, this steel is considered to differ in material characteristics from the steel of the present invention. In the examples which will be given later, a steel analogous to the steel of Japanese Patent Laid-Open No. 4-147948 is used as a comparative alloy for the purpose of comparison with the steel of the present invention. According to the results thus obtained, this steel shows an improvement in creep rupture strength, but its impact value expressing material characteristics concerning toughness is low. When alloy Nos. 1 to 12 shown in Table 1 of Japanese Patent Laid-Open No. 4-147948 are compared in terms of the B equivalent (B+0.5N) proposed by the present invention, most of the alloys (No. 4, No. 5 and Nos. 8 to 11) have a B equivalent greater than 0.030%. Consequently, it is feared that the formation of eutectic $Fe_2B$ and BN may make forging impossible and cause a reduction in mechanical properties. Thus, there is a possibility that manufacture using a large-sized steel ingot will be difficult.

On the other hand, the steel of Japanese Patent Laid-Open No. 7-34202 is analogous to the alloy composition of the above-mentioned Japanese Patent Laid-Open No. 4-147948. However, they differ from each other in that the former is said to be a heat-resisting steel having a ferrite/martensite structure rather than a 100% tempered martensite structure and in that Re is newly added with a view to improving toughness among the material characteristics of Japanese Patent Laid-Open No. 4-147948. In the claims of Japanese Patent Laid-Open No. 7-34202, it is stated that Re is contained in an amount of 3.0% or less. More specifically, among alloy Nos. 1 to 10 shown in Table 1 thereof, most of them (Nos. 2 to 8 and No. 10) are characterized by containing Re in an amount of 0.048 to 1.205%.

However, the impact values at room temperature (20° C.) of the above alloys shown in Table 2 are within the range of 1.5 to 1.9 kgf-m/cm$^2$ and are lower than the impact value (4.5 kgf-m/cm$^2$) of alloy No. 2 shown in Table 2 of Japanese Patent Laid-Open No. 4-147948. Thus, the addition of Re cannot be expected to produce a toughness-improving effect. Moreover, the unit cost of elemental Re per unit weight is 500 to 800 times that of iron. Although the amount of Re added is slight as described above, the unit cost of an alloy used for large-sized steel ingots weighing as heavy as several tens of tons is much higher than those of conventional 12% Cr heat-resisting steels. This poses a problem in that the economy of the heat-resisting steel is greatly detracted from.

In recent years, attempts have been made to achieve increasingly higher efficiencies and increasingly greater capacities in steam turbines. From the viewpoint of higher efficiencies, the steam pressure and temperature tend to be raised to 316 kg/cm$^2$ or above and 593° C. or above, respectively, for the purpose of improving thermal efficiency. Consequently, the temperature of the rotor is also raised. Even if the new heat-resisting steel proposed as described above is employed, it is difficult to use this heat-resisting steel at a steam temperature of 650° C. which corresponds to its maximum service temperature. From the viewpoint of greater capacities, the size required on the basis of rotor design is increased, and a forged product for use as a rotor has come to weigh as heavy as 50 tons or greater. This poses several problems concerning the prevention of segregation and the improvement of toughness in the manufacture of rotors.

Moreover, it is required that high-temperature and high-pressure member such as the rotors of a thermal electric power plant have a good material characteristic balance between high-temperature strength and toughness, and show little change in material characteristics when used at the service temperature of the plant for a long period of time.

Conventionally used 12% Cr heat-resisting steels generally have a relatively good material characteristic balance between high-temperature strength and toughness. However, if they are subjected to long-time creep at high temperatures above 600° C., their metallographic structure undergoes considerable changes. Specifically, the $M_{23}C_6$ type carbides precipitated at grain boundaries or martensite lath boundaries are coarsened significantly, and the MX type carbonitrides precipitated within martensite laths are also coarsened, so that the recovery of dislocations and the formation of subgrains occur actively. As a result, material characteristics such as high-temperature strength are markedly reduced in response to those structural changes. Consequently, it is feared that, when large-sized members such as steam turbine rotors are formed and operated at a steam temperature of 600° C. or above, the reliability of the thermal electric power plant may be detracted from.

Thus, in order to manufacture steam turbines which can be used even at a steam temperature of 650° C., the 12% Cr heat-resisting steels (for example, that disclosed in Japanese Patent Publication No. 57-25629) described above as high-pressure and intermediate-pressure rotor materials are still unsatisfactory they have a 600° C.-$10^5$ hour creep rupture strength of at most 8 to 10 kgf/mm$^2$. Accordingly, there is a need for the development of a heat-resisting steel having more excellent high-temperature strength.

In view of these considerations, a first object of the present invention is to provide a rotor material having excellent long-time creep rupture strength, notched creep rupture strength, creep rupture ductility and toughness even under the above-described severe steam conditions.

A second object of the present invention is to provide a rotor material which is excellent not only in strength at high temperatures, but also in toughness at room temperature. The reason for this is that, in a steam turbine for use in thermal electric power generation, low toughness at room temperature involves the risk of causing brittle fracture during starting of the aforesaid turbine.

A third object of the present invention is to provide a rotor having high ductility for the purpose of preventing the formation of cracks by thermal fatigue. When the stoppage and starting of a turbine are frequently repeated in response to variations in electric power demand between the daytime and the nighttime, only the surfaces of the rotor are rapidly cooled, especially at the time of stoppage, to produce thermal stresses. This may lead to the formation of cracks by thermal fatigue. In order to prevent such crack formation by thermal fatigue, the rotor material needs to have high ductility.

A fourth object of the present invention is to provide a rotor material which exhibits excellent properties (in particular, long-time creep rupture strength and room-temperature toughness) not only in the peripheral region of the rotor, but also in the central part thereof. In steam turbines having a high power generation capacity of 600 to 1000 MW, the high-pressure and intermediate-pressure rotors weigh as heavy as several tens of tons. Consequently, even when such a rotor is quenched with oil, water spray or the like after solution treatment, the cooling rate of the central part of the rotor is of the order of 100° C./hr. When it is quenched at such a low cooling rate, pro-eutectoid ferrite may be precipitated in the course of quenching, resulting in a failure to achieve desired strength and toughness. In the present invention, therefore, tests are performed under conditions simulating the cooling conditions of the central part of a rotor as will be described later. Thus, there is provided a steel which can impart high long-time creep rupture strength and very excellent toughness to the central part of large-sized rotors.

A fifth object of the present invention is to provide a rotor material whose tempering temperature is sufficiently higher than its service temperature so that its strength will not be significantly reduced even after long-time service at high temperatures.

A sixth object of the present invention is to provide a rotor material characterized in that, when it is formed into a forged product weighing as heavy as several tens of tons, the formation of eutectic NbC is inhibited in the steel ingot maing step in which molten steel is solidified, the formation of eutectic $Fe_2B$ and BN is inhibited in the forging step in which the material is heated to 900°–1200° C., and no δ-ferrite is formed in the heat treatment step in which the material is quenched from 1050°–1150° C. The formation of eutectic NbC as described above causes a reduction in mechanical properties, and the formation of eutectic $Fe_2B$ causes cracking and thereby makes forging impossible. Moreover, the formation of BN causes a reduction in mechanical properties, and the formation of δ-ferrite causes a marked reduction in fatigue strength during high-temperature service. Accordingly, none of eutectic NbC, eutectic $Fe_2B$, BN and δ-ferrite must be formed.

DISCLOSURE OF THE INFORMATION

The present inventors have reexamined conventional heat-resisting steels and have investigated the optimum contents of various elements in order to achieve higher strength. As a result, Co has been positively added in a relatively larger amount than in conventional heat-resisting steels of the same type, with a view to stabilizing the tempered martensite structure and increasing resistance to temper softening. Moreover, Mo and W have been concurrently added with a view to improving high-temperature strength. In this connection, the Mo equivalent (Mo+0.5W) has been added in a large amount than conventional, by increasing the content of W as compared with Mo. Thus, it has been found that high-temperature strength can further be improved owing to the synergistic effect of the Mo equivalent and Co. The present invention has been completed on the basis of this finding.

That is, a first high-strength and-high-toughness heat-resisting steel in accordance with the present invention is characterized in that it is formed from a heat-resisting steel containing, on a weight percentage basis, 0.08 to 0.25% carbon, up to 0.10% silicon, up to 0.10% manganese, 0.05 to 1.0% nickel, 10.0 to 12.5% chromium, 0.6 to 1.9% molybdenum, 1.0 to 1.95% tungsten, 0.10 to 0.35% vanadium, 0.02 to 0.10% niobium, 0.01 to 0.08% nitrogen, 0.001 to 0.01% boron, and 2.0 to 8.0% cobalt, the balance being substantially iron, and having a structure consisting of a tempered martensite matrix.

A second high-strength and high-toughness heat-resisting steel in accordance with the present invention is characterized in that, in the heat-resisting steel containing, on a weight percentage basis, 0.08 to 0.25% carbon, up to 0.10% silicon, up to 0.10% manganese, 0.05 to 1.0% nickel, 10.0 to 12.5% chromium, 0.6 to 1.9% molybdenum, 1.0 to 1.95% tungsten, 0.10 to 0.35% vanadium, 0.02 to 0.10% niobium, 0.01 to 0.08% nitrogen, 0.001 to 0.01% boron, and 2.0 to 8.0% cobalt, the balance being substantially iron, and having a structure consisting of a tempered martensite matrix, the Cr equivalent defined by the following equation:

$$\text{Cr equivalent}=\text{Cr}+6\text{Si}+4\text{Mo}+1.5\text{W}+11\text{V}+5\text{Nb}-40\text{C}-2\text{Mn}-4\text{Ni}-2\text{Co}-30\text{N}$$

is 7.5% or less, the B equivalent defined by (B+0.5N) is 0.030% or less, the Nb equivalent defined by (Nb+0.4C) is 0.12% or less, the Mo equivalent defined by (Mo+0.5W) is from 1.40 to 2.45%, and, among unavoidable impurity elements, sulfur is limited 0.01% or less and phosphorus is limited to 0.03% or less.

A third high-strength and high-toughness heat-resisting steel in accordance with the present invention is the above-described first or second heat-resisting steel wherein it is formed from the heat-resisting steel in which $M_{23}C_6$ type carbides and intermetallic compounds are precipitated chiefly at grain boundaries and martensite lath boundaries, and MX type carbonitrides are precipitated within martensite laths, the combined amount of these precipitates being from 1.8 to 4.5% by weight.

A fourth high-strength and high-toughness heat-resisting steel in accordance with the present invention is characterized in that it is formed from the heat-resisting steel having an initial austenite grain diameter of 45 to 125 $\mu$m.

A fifth high-strength and high-toughness heat-resisting steel in accordance with the present invention is the above-described first, second or third heat-resisting steel wherein it is formed from the heat-resisting steel which has been subjected to a solution and hardening heat treatment at a temperature of 1050° to 1150° C., then to a first-step tempering heat treatment at a temperature of at least 530° to 570° C., and then to a second-step tempering heat treatment at a higher temperature of 650° to 750° C.

Furthermore, a sixth high-strength and high-toughness heat-resisting steel in accordance with the present invention is characterized in that the steel ingot used to form the aforesaid heat-resisting steel is obtained by using the electroslag remelting method or a steel ingot making method corresponding thereto (e.g., the electroslag antipiping method).

In the manufacture of large-sized rotors, massive NbC may be formed (or crystallize out) when molten steel solidifies in the step of making a steel ingot. Such coarse NbC causes a reduction in mechanical characteristics. Accordingly, it is essential to avoid the formation of such NbC in the step of making a steel ingot. In the present invention, the sum of niobium and 0.4 time carbon is defined as the Nb equivalent, and the formation of NbC is avoided by controlling it so that $\text{Nb}+0.4\text{C}\leqq 0.12\%$. Moreover, eutectic $Fe_2B$ and BN may be formed when the material is heated to and held at 900°–1200° C. in the succeeding forging step. The formation of eutectic $Fe_2B$ causes cracking and thereby makes forging impossible, and the formation of BN causes a reduction in mechanical properties. Accordingly, it is essential to avoid the formation of such eutectic $Fe_2B$ and BN during forging. In the present invention, the sum of B and 0.5 time N is defined as the B equivalent, and the formation of $Fe_2B$ and B is avoided by controlling it so that $\text{B}+0.5\text{N}\leqq 0.030\%$. Furthermore, massive δ-ferrite may be formed when the material is subjected to a solution heat treatment at 1050°–1150° C. in the heat treatment step. The formation of such massive δ-ferrite induces forge cracking and causes a marked reduction in fatigue strength. Accordingly, it is essential to avoid the formation of such δ-ferrite during heat treatment. In the present invention, the formation of δ-ferrite is avoided by limiting the conventionally proposed Cr equivalent to 7.5% or less. Among unavoidable impurity elements, S is limited 0.01% or less and P is limited to 0.03% or less.

Since Co causes a reduction in Charpy impact value, the addition of a large amount of Co has conventionally been considered to be unsuitable for W-containing steels which tend to show a reduction in ductility. However, as will be described in an example, it has been found that the addition of 2.0% or more (preferably about 4.0%) of Co is rather markedly effective in the improvement of high-temperature strength. Accordingly, 2.0% or more of Co is added for the purpose of achieving sufficient solid solution of Mo and W and securing structural stability during long-time service.

Now, the reasons why the composition and constituent contents of a heat-resisting steel used to form the high-strength and high-toughness heat-resisting steel of the present invention are limited as described above will be given below. In the following description, all percentages used to represent constituent contents are by weight.

Carbon (C)

C serves to secure hardenability. During the tempering process, it combines with Cr, Mo, W and the like to form $M_{23}C_6$ type carbides at grain boundaries and martensite lath boundaries, and combines with Nb, V and the like to form MX type carbonitrides with martensite laths. High-temperature strength can be improved as a result of strengthening by precipitation of the aforesaid $M_{23}C_6$ type carbides and MX type carbonitrides. In addition to the securing of yield strength and toughness, C is an indispensable element required to inhibit the formation of δ-ferrite and BN. In order to achieve the yield strength and toughness required for the rotor material of the present invention, C must be present in an amount of 0.08% or greater. However, unduly large amounts of C rather causes a reduction in toughness and induces excessive precipitation of $M_{23}C_6$ type carbides which reduces the strength of the matrix and thereby detracts from high-temperature strength on the long-time side. Accordingly, the content of C is limited within the range of 0.08 to 0.25%. The preferred range is from 0.09 to 0.13%. The more preferred range is from 0.10 to 0.12%.

Silicon (Si)

Si is an element which is effectively used as a deoxidizer for molten steel. However, the addition of Si in large amounts cause the deoxidation product $SiO_2$ to be present in the steel, detracting from the cleanliness of the steel and reducing the toughness thereof. Moreover, Si promotes the formation of the Laves phases ($Fe_2M$) which are intermetallic compounds, and causes a reduction in creep rupture ductility due to intergranular segregation or the like. Furthermore, since Si promotes temper embrittlement during high-temperature service, it is regarded as a harmful element and its content is limited to 0.10% or less. In recent years, the vacuum carbon deoxidation method or the electroslag remelting method is being employed, so that deoxidation with Si is not always required. In such a case, the content of Si can be reduced to 0.05% or less.

Manganese (Mn)

Mn an element which is effective for use as a deoxidizing and desulfurizing agent for molten steel and also effective in increasing hardenability and thereby improving strength. Moreover, Mn is effective for use as an element which inhibits the formation of δ-ferrite and BN and promotes the precipitation of $M_{23}C_6$ type carbides. However, Mn reduces creep rupture strength in proportion to its content. Accordingly, the content of Mn is limited to at most 0.1%. The preferred range is from 0.05 to 0.1%.

Nickel (Ni)

Since Ni is an effective element which increases the hardenability of steel, inhibits the formation of δ-ferrite and BN, and improves strength and toughness at room temperature, a minimum content of 0.05% is required. Ni is particularly effective in the improvement of toughness. Moreover, when the contents of both Ni and Cr are high, these effects are markedly enhanced because of their synergistic action. However, if its content exceeds 1.0%, Ni reduces high-temperature strength (creep strength and creep rupture strength) and promotes temper embrittlement. Accordingly, the content of Ni should be within the range of 0.05 to 1.0%. The preferred range is from 0.05 to 0.5%.

Chromium (Cr)

Cr is indispensable for use as a constituent element of $M_{23}C_6$ type carbides which provide oxidation resistance and corrosion resistance and contribute to high-temperature strength owing to precipitation and dispersion strengthening. In order to achieve the above-described effects, a minimum content of 10% is required in the steels of the present invention. However, if its content exceeds 12.5%, Cr forms δ-ferrite and reduces high-temperature strength and toughness. Accordingly, the content of Cr is limited within the range of 10.0 to 12.5%. The preferred range is from 10.2 to 11.5%. Moreover, in the manufacture of large-sized rotors, it is essential to inhibit the precipitation of δ-ferrite during solution heat treatment. In the steels of the present invention, therefore, the Cr equivalent (Cr+6Si+4Mo+1.5W+11V+5Nb−40C−2Mn−4Ni−2Co−30N) is preferably limited to 7.5% or less. Thus, the formation of δ-ferrite can be avoided.

Molybdenum (Mo)

Similarly to Cr, Mo is an element which is important for use as an additional element of ferritic steel. The addition of Mo to steel is effective in increasing hardenability, increasing resistance to temper softening during tempering, and thereby improving room-temperature strength (tensile strength and yield strength) and high-temperature strength. Moreover, Mo acts as a solid solution strengthening element and functions to promote the precipitation of fine $M_{23}C_6$ type carbides and prevent the aggregation thereof. Owing to the formation of other carbides, Mo also acts as a precipitation strengthening element which is very effective in improving high-temperature strengths such as creep strength and creep rupture strength. Furthermore, Mo is a very effective element which, when added in an amount of about 0.5% or greater, can inhibit the temper embrittlement of steel. However, the addition of excess Mo induces the formation of δ-ferrite and thereby causes a marked reduction in toughness and, moreover, leads to the new precipitation of Laves phases ($Fe_2M$) which are intermetallic compounds. In the steels of the present invention, however, the concurrent addition of Co inhibits the above-described formation of δ-ferrite. Accordingly, the upper limit of the content of Mo can be increased to 1.9%. Thus, the content of Mo should be within the range of 0.6 to 1.9%.

Tungsten (W)

W is more effective than Mo in inhibiting the aggregation and coarsening of $M_{23}C_6$ type carbides. Moreover, W acts as a solid solution strengthening element which is effective in improving high-temperature strengths such as creep strength and creep rupture strength, and this effect is more pronounced when W is added in combination with Mo. However, if W is added in large amounts, it tends to form δ-ferrite and Laves phases ($Fe_2M$) which are intermetallic compounds, resulting a reduction in ductility and toughness and also a reduction in creep rupture strength. Furthermore, the content of W is affected not only by the content of Mo, but also by the content of Co which will be discussed later. When the content of Co is within the range of 2.0 to 8.0%, the addition of more than 2% of W may induce undesirable phenomena (e.g., solidification segregation) in large-sized forged products. In view of these facts, the content of W should be within the range of 1.0 to 1.95%. The effects produced by the addition of W are more pronounced when W is added in combination with Mo. Their amount added (i.e., Mo+0.5W) is preferably limited within the range of 1.40 to 2.45%. This (Mo+0.5W) is defined as the Mo equivalent.

Vanadium (V)

Similarly to Mo, V is an element which is effective in the improvement of strength (tensile strength and yield strength) at room temperature. Moreover, V forms a fine carbonitride within martensite laths, and this fine carbonitride controls the recovery of dislocations occurring during creep and thereby increases high-temperature strengths such as creep strength and creep rupture strength. Consequently, V is important as a precipitation strengthening element and also as a solid solution strengthening element. If its amount added is within a certain range (0.03 to 0.35%), V is also effective in making crystal grains finer and thereby improving toughness. However, if V is added in unduly large amounts, it not only reduces toughness, but also fixes carbon to an excessive degree and decreases the precipitation of $M_{23}C_6$ type carbides, resulting in a reduction in high-temperature strength. Accordingly, the content of V should be within the range of 0.10 to 0.35%. The preferred range is from 0.15 to 0.25%.

Niobium (Nb)

Similarly to V, Nb is an element which is effective in increasing room-temperature strengths such as tensile strength and yield strength, and high-temperature strengths such as creep strength and creep rupture strength. At the same time, Nb is also an element which is very effective in improving toughness by forming fine NbC and making crystal grains finer. Moreover, some Nb passes into solid solution during hardening and precipitates during the tempering process in the form of a MX type carbonitride combined with the above-described carbonitride of V, and thereby shows the effect of improving high-temperature strength. So, the addition of minimum 0.02% of Nb is required. However, when its addition exceeds 0.1%, it fixes carbon to an excessive degree and decreases the precipitation of $M_{23}C_6$type carbides and reduces high-temperature strength. Therefore, the content of Nb should be within the range of 0.02% to 0.10%. The preferred range is from 0.02% to 0.05%. In the manufacture of large-sized rotors, massive NbC may crystallize out during the solidification of a steel ingot, and this massive NbC may exert an adverse effect on mechanical properties. Accordingly, the sum of Nb and 0.4 time C (i.e., Nb+0.4C) is preferably limited to 0.12% or less. This (Nb+0.4C) is defined as the Nb equivalent. Thus, the formation of massive NbC can be avoided.

Boron (B)

Owing to the effect of strengthening grain boundaries and the effect of preventing the aggregation and coarsening of $M_{23}C_6$ type carbides by passing into solid solution in them, B is effective in the improvement of high-temperature strength. Although the addition of at least 0.001% of B is effective, more than 0.010% of B is detrimental to weldability and forgeability. Accordingly, the content of B is limited within the range of 0.001 to 0.010%. The preferred range is from 0.003 to 0.008%. In the manufacture of large-sized rotors, eutectic $Fe_2B$ and BN may be formed during forging in which the material is heated to 900°–1200°

C., and they may make forging difficult and exert an adverse influence on mechanical properties. Accordingly, the sum of B and 0.5 times N (i.e., B+0.5N) is preferably limited to 0.030% or less. This (B+0.5N) is defined as the B equivalent. Thus, the formation of eutectic $Fe_2B$ and BN can be avoided.

Nitrogen (N)

N functions to improve high-temperature strength by precipitating a nitride of V and, in cooperation with Mo and W, producing an IS effect (i.e., the interaction of an interstitial solid solution element and a substitutional solid solution element) in its solid solution state. Thus, a minimum content of 0.01% is required. However, since more than 0.08% of N causes a reduction in ductility, the content of N is limited within the range of 0.01 to 0.08%. The preferred range is from 0.02 to 0.04%. Moreover, in the copresence of B as described above, N may promote the formation of eutectic $Fe_2B$ and BN. Accordingly, it is preferable as described above that the B equivalent (B +0.5N) be limited to 0.030% or less.

Cobalt (Co)

Co is an important element which characterizes the present invention by distinguishing it from prior inventions. Co contributes to solid solution strengthening and has the effect of inhibiting the precipitation of δ-ferrite, so that it is useful in the manufacture of large-sized forged products. In the present invention, the addition of Co makes it possible to add alloying elements without altering the $A_{c1}$ transformation point (about 780° C.) significantly, resulting in a marked improvement high-temperature strength. This is believed to be probably due to its interaction with Mo and W, and is a phenomenon characteristic of the steels of the present invention in which the Mo equivalent (Mo+0.5W) is 1.40% or greater. In order to achieve these effects of Co positively, the lower limit of the Co content in the steels of the present invention should be 2.0%. On the other hand, since the addition of excess Co results in a reduction in ductility and an increase in cost, its upper limit should be 8%. Accordingly, the content of Co should be within the range of 2.0 to 8.0%. The preferred range is from 4.0 to 6.0%. Moreover, in the manufacture of large-sized rotors, it is essential to inhibit the precipitation of δ-ferrite during solution heat treatment. Co is an element which is effective in reducing the Cr equivalent (Cr+6Si+4Mo+1.5W+11V+5Nb−40C−2Mn−4Ni−2Co−30N) serving as a parameter for predicting the precipitation of δ-ferrite. In the steels of the present invention, the Cr equivalent is preferably limited to 7.5% or less. Thus, the formation of δ-ferrite can be avoided.

Others

P, S, Cu and the like are unavoidable impurity elements originating from the raw materials used for steel making, and it is desirable that their contents be as low as possible. However, since the careful selection of raw materials leads to an increase in cost, it is desirable that the content of P be not greater than 0.03% and preferably 0.015%, the content of S be not greater than 0.01% and preferably 0.005%, and the content of Cu be not greater than 0.50%. Other impurity elements include Al, Sn, Sb, As and the like.

Next, the temperature employed for the solution and hardening heat treatment is explained below. In the heat-resisting steels of the present invention, 0.02 to 0.10% of Nb is added because it is effective in precipitating a MX type carbonitride and thereby improving high-temperature strength. In order to achieve this effect, it is essential to bring Nb completely into solid solution in austenite during solution heat treatment. However, if the quenching temperature is lower than 1050° C., the coarse carbonitride precipitated during solidification remains even after the heat treatment. Consequently, Nb does not function quite effectively to increase creep rupture strength. In order to bring this coarse carbonitride once into solid solution and precipitate it densely as a fine carbonitride, it is necessary to quench the steel from an austenitizing temperature of 1050° C. or above at which austenitization proceeds further. On the other hand, if the quenching temperature exceeds 1150° C., a temperature region is entered where δ-ferrite is precipitated in the heat-resisting steels of the present invention. At the same time, a marked coarsening of the grain diameter occurs, resulting in a reduction in toughness. Accordingly, it is preferable that the quenching temperature be within the range of 1050° to 1150° C.

Next, the temperature employed for the tempering heat treatment is explained below. The heat-resisting steels of the present invention have the following three features. A first feature is that, in order to completely remove the austenite remaining after quenching, a first-step tempering heat treatment at a temperature of 530° to 570° C. is employed. A second feature is that $M_{23}C_6$ type carbides and intermetallic compounds are precipitated chiefly at grain boundaries and martensite lath boundaries. The third feature is that there is employed a heat treatment process using a tempering heat treatment temperature range of 650° to 750° C. where MX type carbonitrides can be precipitated within martensite laths.

If the tempering heat treatment temperature is lower than 650° C., the precipitation of the aforesaid $M_{23}C_6$ type carbides and MX type carbonitrides cannot attain equilibrium satisfactorily, resulting in a relative reduction in the volume fraction of the precipitates. Moreover, when these precipitates in such an unstable state are subsequently subjected to creep at high temperatures above 600° C. for a long period of time, the precipitation proceeds further and the aggregation and coarsening of the precipitates becomes more pronounced.

On the other hand, if the tempering heat treatment temperature exceeds 750° C., the density of the MX type carbonitrides precipitated within martensite laths is reduced, the tempering becomes excessive, and the transformation point to austenite ($A_{c1}$=about 780° C.) is approached. Accordingly, it is preferable that the tempering heat treatment temperature be within the range of 650° to 750° C.

By performing the above-described heat treatment, the amount of $M_{23}C_6$ type carbides precipitated at grain boundaries and martensite lath boundaries is controlled so as to be within the range of 1.5 to 2.5% by weight, the amount of MX type carbonitrides precipitated within martensite laths is controlled so as to be within the range of 0.1 to 0.5% by weight, and the amount of intermetallic compounds precipitated at grain boundaries and martensite lath boundaries is controlled so as to be within the range of 0 to 1.5% by weight. Moreover, the combined amount of the aforesaid precipitates is controlled so as to be within the range of 1.8 to 4.5% by weight. Thus, the resulting steel shows a marked improvement in high-temperature creep rupture strength and creep resistance and a less reduction in properties upon exposure to high temperatures for a long period of time. The especially preferred range of the combined amount of the precipitates is from 2.5 to 3.0% by weight. As to the details of the combined amount of the precipitates, it is particularly preferable to control the amount of $M_{23}C_6$ type carbides precipitated so as to be within the range of 1.6 to 2.0% by weight and the amount of MX type carbonitrides precipitated so as to be within the range of 0.1 to 0.2% by weight. The combined amount of the precipitates is measured by the electrolytic extraction residue method in which a sample is placed in a 10% acetylacetone/1% tetramethylammonium chloride/methanol mixture and the matrix is dissolved by electrolysis.

Next, the grain diameter in the heat-resisting steels of the present invention is explained below. In conventional high-Cr heat-resisting steels, an enlargement of the grain diameter is restrained for the purpose of securing toughness or creep rupture ductility or improving fatigue strength. If the grain diameter is less than 45 μm, the creep rupture strength is low. On the other hand, if the grain diameter is greater than 125 μm, the resulting steel shows a marked reduction in toughness and creep rupture ductility and tends to develop intergranular cracking during quenching. Accordingly, the preferred range of the grain diameter is from 45 to 125 μm.

Finally, the method for making the heat-resisting steels of the present invention is explained below. Ingots of heat-resisting steels in accordance with the present invention are characterized in that they are made by the electroslag remelting method or a steel ingot making method corresponding thereto. Large-sized parts typified by steam turbine rotors tend to show the segregation of additional elements during melt solidification and the non-uniformity of the solidified structure. The heat-resisting steels of the present invention are characterized by the addition of Co and a slight amount of B. In particular, B is an element which tends to be segregated in steel ingots, as compared with C and the like. In the case of the heat-resisting steels of the present invention, it is essential to make large-sized steel ingots by using a steel ingot making method which can inhibit the segregation of B to the utmost extent. Accordingly, the electroslag remelting method or a steel ingot making method corresponding thereto is preferably used with a view to decreasing the segregation of B and the like and improving the integrity and homogeneity of large-sized steel ingots.

BRIEF DESCRIPTION OF THE DRAWINGS

FIG. 1 is a table showing the chemical compositions of heat-resisting steels used in a first example of the present invention;

FIG. 2 is a table showing the results of room temperature tension tests, impact tests and creep rupture tests performed with the heat-resisting steels shown in the table of FIG. 1;

FIG. 3 is a table showing the results of the particle diameter measurement of $M_{23}C_6$ type carbides which was made with creep rupture test specimens used in a second example;

FIG. 4 is a table showing the results of the measurement of metallographic structure and the type and amount of precipitates which was made with as-tempered samples and creep rupture test specimens in a third example;

BEST MODE FOR CARRYING OUT THE INVENTION

Figure 5:
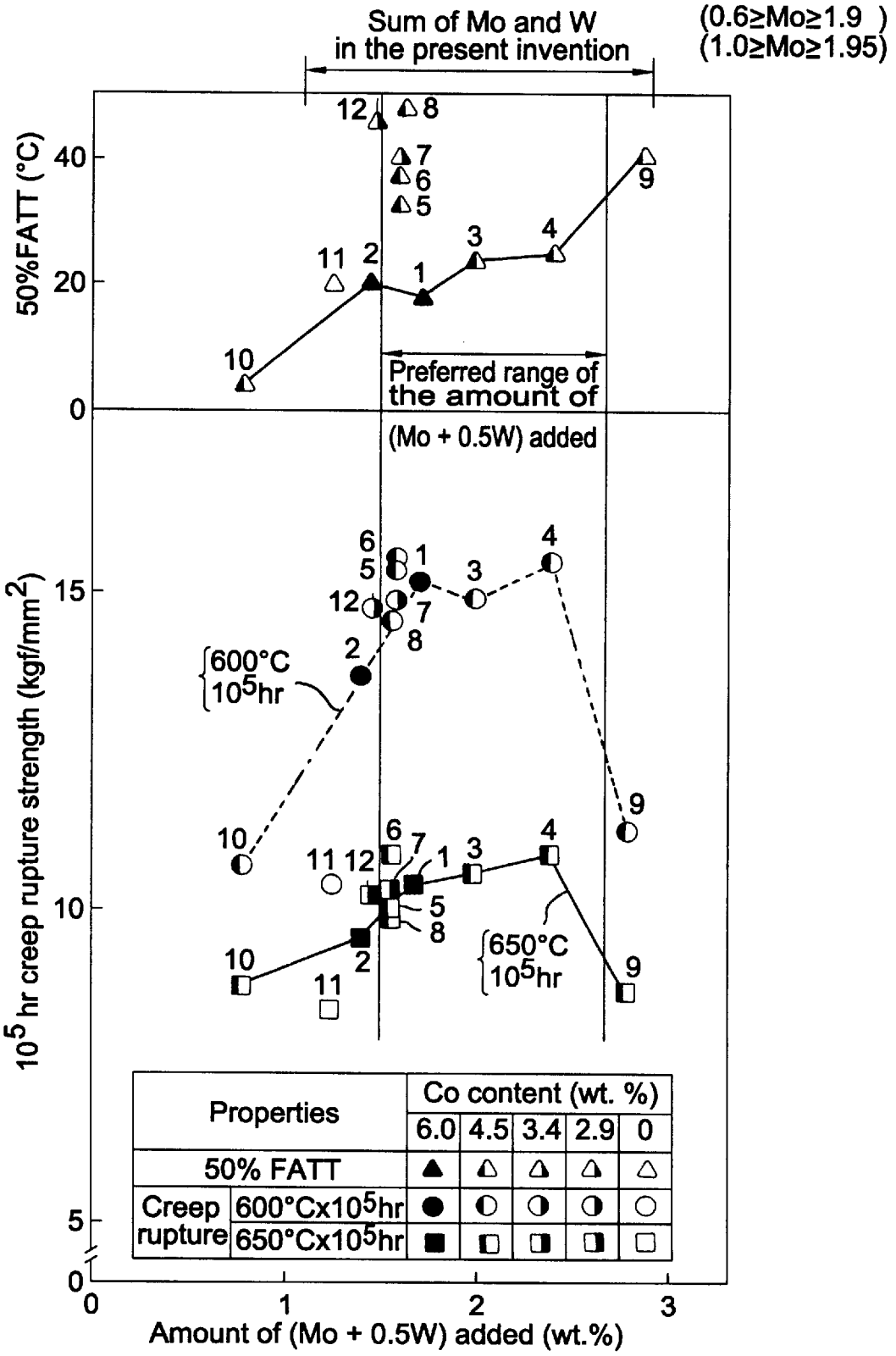
FIG. 5 is a graph showing the relationship between the amount of (Mo+0.5W) added and the creep rupture strength or 50% FATT as observed in the first example of the present invention.

The present invention is more specifically explained with reference to the following examples.

(Example 1)

Material Characteristics Concerning Creep and Toughness

The chemical compositions of 12 heat-resisting steels used as test materials are shown in the table of FIG. 1. Of these, Nos. 1 to 8 are heat-resisting steels having a chemical composition within the scope of the present invention, and Nos. 9 to 12 are comparative steels having a chemical composition outside the scope of the present invention. Of these, Nos. 9 and 10 are steels in which the contents of Mo and W are outside the scope of the present invention. No. 11 is a steel which is disclosed, for example, in Japanese Patent Laid-Open 62-103345 and is being used as a rotor material for high-pressure and intermediate-pressure steam turbines. Moreover, No. 12 is a steel which is disclosed in Japanese Patent Laid-Open 4-147948 mentioned in connection with the prior art and is analogous to the No. 2 alloy of Example 1.

These heat-resisting steels were melted in a laboratory-scale vacuum melting furnace to made steel ingots each weighing 50 kg. Under conditions similar to those employed for actual rotor materials, these steel ingots were uniformly heated and forged (with an upsetting of 1/2.8 U and a stretching of 3.7 S) to form small-sized forged materials. Thereafter, these forged materials were subjected to a preliminary heat treatment (for example, at 1050° C. with air cooling and at 650° C. with air cooling) for the purpose of grain size adjustment. These forged materials were subjected to a heat treatment simulating the quenching rate of the central part of a large-sized steam turbine rotor having a diameter of 1200 mm. That is, they were completely austenitized by heating them at 1090° C. for 15 hours, hardened at a cooling rate equal to the quenching rate of the central part of a rotor (i.e., 100° C./hr), and then subjected to primary tempering at 550° C. for 15 hours and secondary tempering at 725° C. for 23 hours. The conditions employed for the tempering treatments were controlled so that the strength required for the design of rotor materials (i.e., 0.2% yield strength at room temperature) would be 60 kg/mm$^2$ or greater.

With regard to the table of FIG. 1, the sources for formulas (1) and (2) include, for example, the following publications. For formula (1), T. Fujita, T. Sato and N. Takahashi: Transactions ISIJ, Vol. 18, 1978, p. 115; and for formula (2), D. L. Newhouse, C. J. Boyle and R. M. Curran: Preprint of ASTM Annual Meeting, Purdue University, Jun. 13–18, 1965. Formulas (3) and (4) are parameters proposed by the present invention.

Inventive steel Nos. 1 to 8 and comparative steel Nos. 9 to 12 were subjected to tension tests and impact tests at room temperature (20° C.). Impact values and 50% FATT values were obtained from the results of Charpy impact tests and are shown in the table of FIG. 2 together with tensile properties. Moreover, inventive steel Nos. 1 to 8 and comparative steel Nos. 9 to 12 were also subjected to creep rupture tests at temperatures of 600° C. and 650° C. From the results of these tests, the $10^5$ hr creep rupture strengths at 600° C. and 650° C. were estimated by extrapolation. The results thus obtained are also shown in the table of FIG. 2. As is evident from this table, all of the inventive steels exhibited a 0.2% yield strength of 70 kg/mm$^2$ or greater at room temperature, indicating that they have a strength sufficient for use as steam turbine rotor materials. Moreover, their elongation and reduction of area also satisfactorily meet the requirements for common rotor materials (i.e., an elongation of 16% or greater and a reduction of area of 45% or greater). As to impact properties, the desired value of 50% FATT for steam turbine rotor materials is 80° C. or less.

Inventive steel Nos. 1 to 8 and comparative steel Nos. 9 to 11 satisfy the desired value in all cases, indicating that they have sufficient toughness. In contrast, the 50% FATT of No. 12 is as high as 90° C. and does not satisfy the desired value, indicating that its toughness is insufficient for use as a rotor material.

It can be seen from the table of FIG. 2 that the 650° C.×$10^5$ hr creep rupture strengths of inventive steel Nos. 1 to 8 are about 1.2 or more times those of comparative steel Nos. 9 to 11. This indicates that the inventive steels are improved in creep rupture strength and have a markedly longer rupture life. Although the toughness of comparative steel No. 12 does not satisfy the desired value as described above, its creep rupture strength can be regarded as equal to those of inventive steel Nos. 1 to 8.

FIG. 5 is a graph showing the relationship between the Mo equivalent (Mo+0.5W) and the $10^5$ hr creep rupture strength (600° C.×$10^5$ hr, 650° C.×$10^5$ hr) or 50% FATT. The $10^5$ hr creep rupture strength increases with increasing Mo equivalents, and tends to decrease at a Mo equivalent of 2.4 and greater. This indicates that an appropriate Mo equivalent is required to achieve high creep rupture strength. Next, the 50% FATT tends to increase with increasing Mo equivalents. Judging solely from the viewpoint of 50% FATT, the Mo equivalent should be as small as possible. Accordingly, it may be said that, judging from both $10^5$ hr creep rupture strength and 50% FATT, the preferred range of the Mo equivalent (Mo+0.5W) for steels used as rotor materials is from 1.4 to 2.45.

It can be seen from the above discussion that inventive steel Nos. 1 to 8, which are within the compositional range of the present invention, have excellent characteristics.

(Example 2)

Influence of Co on Metallographic Structure

Figure 6:
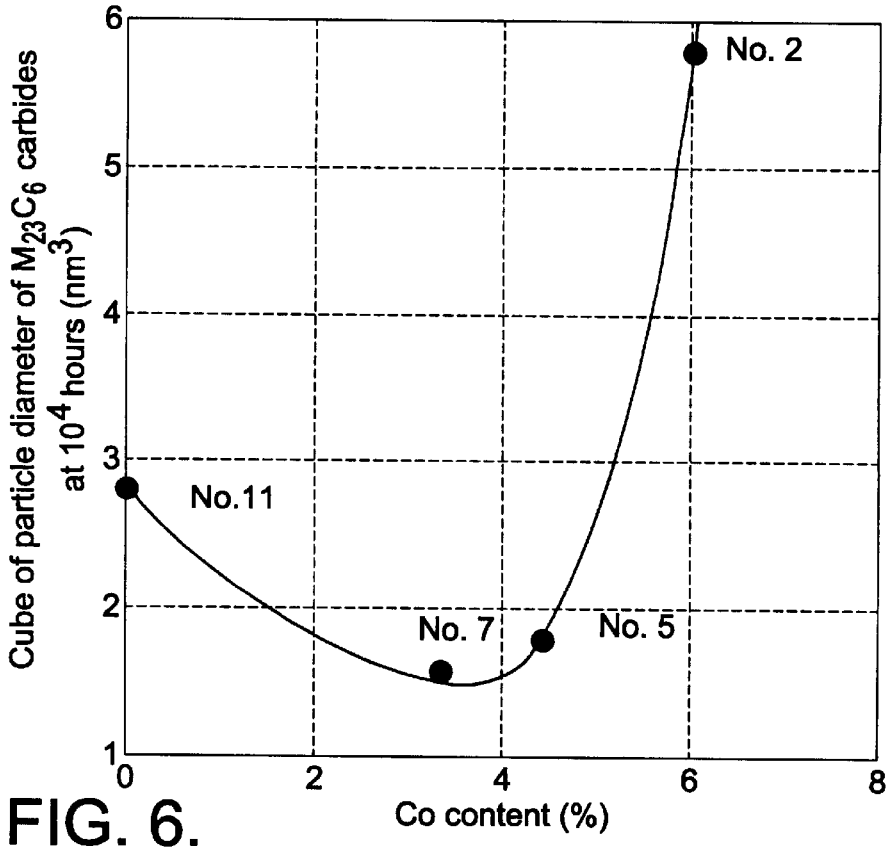
FIG. 6 is a graph showing the relationship between the cube of the particle diameter of $M_{23}C_6$ type carbides at $10^4$ hours and the Co content as observed in the second example of the present invention.

In Example 2, attention is paid to Co that is an important element characterizing the present invention by distinguishing it from prior inventions, and the influence of Co on metallographic structure and, in particular, the metallographic structural stability of $M_{23}C_6$ type carbides and MX type carbonitrides during creep are explained. With respect to specimens used in the creep rupture tests performed at 650° C. in Example 1, the metallographic structure of each ruptured specimen was observed by using an extraction replica of a section of the parallel portion thereof. The alloys used for this observation were chosen so that they had a substantially fixed Mo equivalent (Mo+0.5W=about 1.5%) and varying Co contents. That is, using the samples of No. 2 (Co: 6.0%), No. 5 (Co: 4.5%), No. 7 (Co: 3.4%) and No. 11 (Co: 0%) which had been subjected to creep rupture under conditions including 650° C.-16 kgf/$mm^2$ and 650° C.-14 kgf/$mm^2$ (or 650° C.-10 kgf/$mm^2$ for Nos. 2 and 11), the $M_{23}C_6$ type carbides present at grain boundaries and martensite lath boundaries were observed and the grain diameter thereof was measured. The results thus obtained are shown in the table of FIG. 3. In all of Nos. 2, 5 and 7 and comparative steel No. 11, the grain diameter of the $M_{23}C_6$ type carbides is increased as the creep test time becomes longer, indicating a coarsening of the $M_{23}C_6$ type carbides. The grain diameter of these $M_{23}C_6$ type carbides is increased as the creep test time becomes longer, indicating a coarsening of the $M_{23}C_6$ type carbides. The rate of coarsening of these $M_{23}C_6$ type carbides is considered to depend on the volumetric diffusion of Cr, Fe, Mo, W and the like into the martensite matrix (i.e., the cube rule). Accordingly, the grain diameter at $10^4$ hours was obtained, by extrapolation, from the grain diameter at each rupture time shown in the table of FIG. 3, and the cube of this value was employed as a parameter expressing the degree of coarsening of $M_{23}C_6$ type carbides. The results thus obtained are also shown in the table of FIG. 3. Of these results, the relationship between the cube of the grain diameter at $10^4$ hours and the Co content of each alloy is shown in FIG. 6.

In the heat-resisting steels having a chemical composition within the scope of the present invention, the cube of the grain diameter employed as a parameter expressing the degree of coarsening of $M_{23}C_6$ type carbides decreased gradually as the Co content increased from 0 to 3.4%, reached a minimum value at a Co content of about 4.0%, and increased as the Co content increased beyond 4.5%. MX type carbonitrides showed a tendency similar to that of $M_{23}C_6$ type carbides.

That is, in heat-resisting steels meeting the chemical compositional requirements of the present invention, changes of the metallographic structure of $M_{23}C_6$ type carbides and MX type carbonitrides can be suppressed by controlling the Co content so as to be within the range of about 3.5 to 4.5%, and the structural stability during long-time service can be achieved as contrasted with conventionally used 12% Cr heat-resisting steels. This, in turn, brings about an improvement in creep rupture strength.

(Example 3)

Metallographic Structure and the Type and Amount of Precipitates

Figure 7:
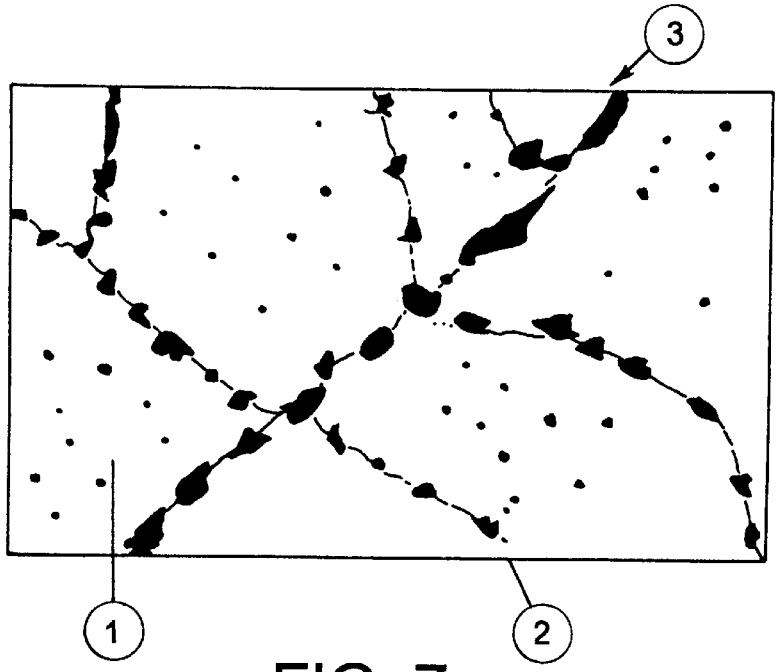
FIG. 7 is a schematic view of a tempered martensite structure observed in the third example of the present invention.

In Example 3, metallographic structure and, in particular, type and amount of precipitates are explained. A typical 100% tempered martensite structure showing the results of the observations made with extraction replicas in Example 2 is schematically illustrated in FIG. 7. As can be seen from this figure, the 100% tempered martensite structure consists of grain boundaries (3) (former austenite grain boundaries), martensite lath boundaries (2) and the interior of martensite laths (1). In the figures, the samples were divided into as-tempered samples and samples having been subjected to creep rupture with respect to the type of precipitates, but there is no particular difference therebetween in the type of precipitates. First of all, massive $M_{23}C_6$ type carbides and granular intermetallic compounds (Laves phases) are precipitated at the grain boundaries (3). From the viewpoint of composition, the $M_{23}C_6$ type carbides are compounds of carbon and M elements such as Cr, Mo and W, and the intermetallic compounds (Laves phases) are of the $Fe_2M$ type in which the M element is Fe, Cr, Mo, W or the like. The above-described $M_{23}C_6$ type carbides and intermetallic compounds (Laves phases) are also precipitated at the martensite lath boundaries (2). Moreover, fine MX type carbonitrides are precipitated in the interior of the martensite laths (1). From the viewpoint of composition, the MX type carbonitrides are fine carbonitrides formed by combining M elements (e.g., Nb and V) with X elements (i.e., C and N). The metallographic structures of sample Nos. 1 to 12 shown in Example 2 consisted of a 100% tempered martensite structure in all cases. Of these, the as-tempered samples of Nos. 2, 5, 7 and 11 and the samples thereof which has been subjected to creep rupture at 600°–650° C. were examined to determine the type and amount of precipitates. The results thus obtained are shown in the table of FIG. 4. Moreover, the 600° C.-$10^5$ hour creep rupture strength was evaluated under the same conditions as in Example 1, and the results thus obtained are also shown in the table of FIG. 4.

When the steels of the present invention were heat-treated in the manner described in Example 1 to adjust the combined amount of precipitates to 1.8–2.5% by weight and then subjected to creep rupture at 600°–650° C., the combined amount of precipitates showed a slight increase and its increment (i.e., the value of (2)–(1) shown in the table of FIG. 4) was less than 0.10% by weight. On the other hand, when comparative steel No. 11 was heat-treated to adjust the combined amount of precipitates to less than 2.8% by weight, its increment (i.e., the value of (2)–(1) shown in the table of FIG. 4) of the combined amount of precipitates after creep rupture was 0.20% by weight or greater. Thus, comparative steel No. 11 shows a markedly greater increment than inventive steel Nos. 2, 5 and 7, indicating that the metallographic structure of the former has lower stability during creep.

Next, the relationship between the steels of the present invention and the creep rupture strength is explained below. Alloy Nos. 2, 5 and 7 in accordance with the present invention showed a 600° C.-$10^5$ hour creep rupture strength of 13.8 kgf/mm$^2$ or greater. However, comparative steel No. 11 showed a marked reduction to 10.5 kgf/mm$^2$ or less.

Thus, by controlling the combined amount of precipitates so as to be within the range of 1.8 to 2.5% by weight, a marked improvement in creep rupture strength can be achieved and changes of the metallographic structure during creep can be suppressed significantly.

Industrial Applicability

As compared with conventional heat-resisting steels for use in steam turbines, the high-strength and high-toughness heat-resisting steels of the present invention show a marked improvement in creep rupture strength, can satisfy design stresses fully, and are hence very useful for industrial purposes. Moreover, they have excellent structural stability when exposed to high temperatures for a long period of time. That is, in contrast to conventional heat-resisting steels of the same type having a Co content of at most 3.0%, the steels of the present invention have a Co content of as high as 2.0 to 8.0%, so that a stabilization of the martensite structure and an increase in resistance to temper softening can be achieved. Moreover, Mo and W are concurrently added for the purpose of improving high-temperature strength. Thus, owing to the high content of Co, Mo and W can be fully brought into solid solution and high structural stability during long-time service can be achieved. The Mo equivalent (Mo+0.5W) is adjusted to a higher level than conventional. Thus, the high-strength and high-toughness heat-resisting steels of the present invention have very great exploitability from an industrial point of view in that they have excellent room-temperature strength, high-temperature strength and toughness, exhibit higher reliability than conventional heat-resisting steels, and can yield forged steel materials such as rotor materials suitable for use in steam turbines having a larger size and a higher temperature (e.g., they exhibit high reliability for a long period of time even under hypercritical-pressure steam conditions and are significantly effective in improving the efficiency of thermal electric power generation).

We claim:

1. A high-strength and high-toughness heat-resisting steel formed from a heat-resisting steel containing, on a weight percentage basis, 0.08 to 0.25% carbon, up to 0.10% silicon, up to 0.10% manganese, 0.05 to 1.0% nickel, 10.0 to 12.5% chromium, 0.6 to 1.9% molybdenum, 1.0 to 1.95% tungsten, 0.10 to 0.35% vanadium, 0.02 to 0.10% niobium, 0.01 to 0.08% nitrogen, 0.001 to 0.01% boron, and 2.0 to 8.0% cobalt, the balance being substantially iron, and having a structure consisting of a tempered martensite matrix.

2. A high-strength and high-toughness heat-resisting steel as claimed in claim 1 wherein the Cr equivalent defined by the following equation:

$$\text{Cr equivalent}=\text{Cr}+6\text{Si}+4\text{Mo}+1.5\text{W}+11\text{V}+5\text{Nb}-40\text{C}-2\text{Mn}-4\text{Ni}-2\text{Co}-30\text{N}$$

is 7.5% or less, the B equivalent defined by (B+0.5N) is 0.030% or less, the Nb equivalent defined by (Nb+0.4C) is 0.12% or less, the Mo equivalent defined by (Mo+0.5W) is from 1.40 to 2.45%, and, among unavoidable impurity elements, sulfur is limited 0.01% or less and phosphorus is limited to 0.03% or less.

3. A high-strength and high-toughness heat-resisting steel as claimed in claim 1 or 2 that is formed from the heat-resisting steel in which $M_{23}C_6$ type carbides and intermetallic compounds are precipitated chiefly at grain boundaries and martensite lath boundaries, and MX type carbonitrides are precipitated within martensite laths, the combined amount of these precipitates being from 1.8 to 4.5% by weight.

4. A high-strength and high-toughness heat-resisting steel as claimed in claim 3 which is formed from the heat-resisting steel having an initial austenite grain diameter of 45 to 125 $\mu$m.

5. A high-strength and high-toughness heat-resisting steel as claimed in claims 1 to 4 wherein the heat-resisting steel is subjected to a solution and hardening heat treatment at a temperature of 1050° to 1150° C., then to a first-step tempering heat treatment at a temperature of at least 530° to 570° C., and then to a second-step tempering heat treatment at a higher temperature of 650° to 750° C.

6. A high-strength and high-toughness heat-resisting steel as claimed in claim 5, wherein said steel subjected to said solution and hardening heat treatment and said tempering heat treatments is formed from an ingot, said ingot having been formed by solidifying molten steel under conditions selected to inhibit segregation of boron.

7. A high-strength and high-toughness heat-resisting steel as claimed in claim 6, wherein said ingot is formed by a process selected from the group consisting of electroslag remelting and electroslag antipiping.

* * * * *

UNITED STATES PATENT AND TRADEMARK OFFICE
CERTIFICATE OF CORRECTION

PATENT NO. : 5,817,192

DATED : October 6, 1998

INVENTOR(S) : Kawai et al.

It is certified that error appears in the above-identified patent and that said Letters Patent is hereby corrected as shown below:

Column 16, line 38, "claims 1 to 4" should read --claim 4--.

Signed and Sealed this

First Day of June, 1999

*Attest:*

*Attesting Officer*

Q. TODD DICKINSON

*Acting Commissioner of Patents and Trademarks*